United States Patent [19]

Maag

[11] Patent Number: 4,757,991

[45] Date of Patent: Jul. 19, 1988

[54] LAT ISOLATING EXERCISE MACHINE

[76] Inventor: Henry Maag, 5332 Clark Cir., Westminster, Calif. 92683

[21] Appl. No.: 6,774

[22] Filed: Jan. 27, 1987

[51] Int. Cl.[4] ..... A63B 21/00

[52] U.S. Cl. ..... 272/134; 272/117

[58] Field of Search ..... 272/117, 118, 134, 93; 128/25 R

[56] References Cited

U.S. PATENT DOCUMENTS

| | | | |
|---|---|---|---|
| 3,917,262 | 11/1975 | Salkeld | 272/134 |
| 4,211,403 | 7/1980 | Coffaro et al. | 272/134 |
| 4,621,810 | 11/1986 | Cummins | 272/134 |

OTHER PUBLICATIONS

Universal Catalog 1983–1984, p. 24, "No. 3211 SR High Pulley Machine".

*Primary Examiner*—Richard J. Apley
*Assistant Examiner*—J. Welsh

[57] ABSTRACT

An arm adduction exercise machine which utilizes two frame-journaled mechanically-linked counter-rotating effort arms to apply variably resistive force to an operator's arm adducting muscles via body-machine contact with the back of the operator's upper arm and the side of the operator's corresponding hip. The upper of these two effort arms, which contains the upper arm engaging contact surface, rotates about an axis which is approximately common with the sagittal axis of rotation of the operator's exercising shoulder joint. The lower of these two effort arms, which contains the corresponding hip engaging contact surface, rotates about a parallel axis which is approximately common with the center of the operator's back. The position of the operator's exercising shoulder joint is maintained while performing the exercise by a horizontally adjustable frame-mounted body-machine contact surface which engages the side of the operator's non-exercising shoulder and a vertically adjustable lower effort arm mounted body-support surface which engages the operator's seat while performing the exercise from the seated operating position. A rotating weight arm assembly is journaled in the machine's frame on an axis which is parallel with the axis of rotation of the upper effort arm. The rotating weight arm assembly and the upper effort arm are mechanically linked to each other by a connecting link which together with these two rotating assemblies and the frame of the machine form a four-bar linkage system. This four-bar linkage system, together with the rotating weight arm, applies a variably resistive force at the arm and hip engaging surfaces which varies as a function of the position of the arm and hip engaging contact surfaces and is correlated to the normal strength-to-position force applying capabilities of the average operator in the arm adduction exercise movement.

2 Claims, 5 Drawing Sheets

LAT ISOLATING EXERCISE MACHINE

This invention relates to exercise equipment, in particular to an exercise machine which develops an operator's arm adducting muscles by utilizing two mechanically linked counter-rotating effort arms to supply variably resistive force to the back of the operator's upper arm through a circular path about his shoulder joint and to the side of the operator's hip through a circular path about the center of his back.

The following is an application for a patent on an improvement in a device which is not obvious to people skilled in exercise equipment design, as evidenced by the fact that such a device is not on patent or on the market. In particular, a two-sided unilateral exercise machine which develops the arm adducting muscles, on one side of the operators back at a time, by applying a variably resistive force to these muscles throughout a full range of isolated arm adduction, which is obtained through the use of two coplanar mechanically linked rotating effort arms which are mechanically linked to a 4-bar linkage/rotating weight arm force varying mechanism.

BACKGROUND AND ADVANTAGES OF THE INVENTION

To most effectively develop any particular muscle group a resistive force should be applied to that muscle group which: (1) isolates, as much as is possible, the muscle group being developed while applying minimum components of force to other muscle groups. (2) is applied throughout the greatest possible range of contraction of the muscle group. (3) varies as a function of the positionally related strength capabilities of the muscle group as it actuates the body joint(s) being moved.

A major problem with present day "lat developing" machines, like the pulldown machine and the rowing machine, is that they do not isolate the arm adducting (latissimus dorsi or "lat") muscles of the back, which is due to the fact that they utilize a "pulling" movement which involves not only arm adduction but also concurrent arm flexion. "Pulling" movements, which involve flexion of the arms, bring the much weaker "arm flexing" biceps into the exercise movement and consequently limit the lat building potential of the exercise to the strength of the much weaker bicep muscles of the upper arms. The machine disclosed in this application, on the other hand, by fixing the position of the operator's shoulder joint and using a body-machine force-transmitting contact surface which applies a resistive force to the back side of the operator's upper arm through a circular path about the opeator's shoulder joint, eliminates the arm flexing component common to "pulling" movements leaving a pure arm adduction movement which isolates the arm adducting lat muscles so that their muscle building potential is no longer limited by the much weaker bicep muscles.

The arm adducting latissimus dorsi muscles of the back have their distal insertions in the humerus bone of the upper arm and their proximal insertions in the lumbar vertebrae and hip bone in the lower back region. This means that they cross not only the shoulder joint but also many spinal joints and therefore, upon contraction, not only adduct the arm but also curve the spine and rotate the hips upward toward the side contracting. This means that a greater range of contraction (and therefore muscle building potential) is available by not only rotating the arm about the shoulder joint but also concurrently rotating the hip and spine about some point of rotation which allows the lat muscles points of proximal insertion to move closer to their point of distal insertion throughout the exercise movement. The machine disclosed in this application takes advantage of the fact that the lat muscles cross more than one body joint, and obtains a greater range of muscle building contraction by exercising one side of the operator's body at a time, through the use of two rotating effort arms which apply resistive force to the operator's body at the back of the upper arm and the side of the hip on one side of the operator's body and an adjustable body-machine contact surface which fixes the position of the operator's rotating shoulder joint by applying a constraining force to the upper outside of the operator's non-rotating shoulder on the other side of the operator's body.

The few "lat developing" machines on the market which do apply a resistive force throughout a pure arm adduction movement are all of a bilateral design (both sides of the body being exercised concurrently), which does not allow the hip and spine to rotate toward the side contracting which, in turn, decreases the available range of contraction of the arm adducting lat muscles and consequently decreases the lat building potential of the exercise movement.

Due to joint mechanics, angles of pull of the lat muscles, and physiological make-up of the lat muscles, more force can be applied in the beginning through the middle of the arm adduction movement than toward the end of the movement, and the resistive force which the machine applies should vary in accordance. Most present day "lat developing" machines, like the pulldown machine or the rowing machine, apply a constant load which does not vary to correspond with the positionally related strength capabilities of the lat muscles being developed (this is the reason for the increased difficulty in a pulldown or rowing movement toward the end of the movement). The machine disclosed in this application, on the other hand, through the use of a 4-bar linkage/rotating weight arm force-varying mechanism which is mechanically linked to the two rotating effort arms on the machine, applies a resistive force which varies to correspond with the normal ability of the lat muscles to apply force throughout this body movement which, of course, results in greater lat building potential.

The few "lat developing" machines on the market which do apply a variably resistive force throughout a pure arm adduction movement, do it through the use of cams used in conjunction with cables or chains, all of which have inherent problems. The problem with cams is that they are relatively hard to manufacture. The problem with cables is that because of their relatively small cross sectional area, they carry very high stresses (a ⅛" cable carrying 200 lbs, for example, has a tensile stress in it of approximately 16,300 psi). These already high stresses are multiplied and become cyclic (introducing fatigue wear) when a cable moves along bending over a small diameter pulley. Because of the high tensile stresses involved, cables stretch (eventually decreasing the machine's intended range of motion) and eventually fray and wear out (leading to replacement or catastropic failure). Chains, while not suffering the fatigue wear that cables do, are subject to stretching at their many joints (which again decreases the machine's intended range of motion). They, also like cables, are subject to relatively high tensile stresses and in addition are noisy and introduce spurious drag to the machine. The force varying mechanism used on the machine disclosed in this application, on the other hand, consist of only three moving parts connected to each other and to the frame of the machine at a total of four pivotal joints, forming a 4-bar linkage. The three moving parts are all rigid members with relatively large cross sectional areas, which both eliminates the need to fabricate a relatively complex cam and eliminates the problem of deformation or failure of the moving parts due to excessive loads and fatigue (a disadvantage of cables and chains). Due to the fact that the force varying mechanism used on this machine has only four pivotal joints (and indeed, the whole machine has only seven pivotal joints), stretching at joints, noise, and spurious drag (disadvantages of chains) are all greatly reduced.

A body building machine must, of course, be practical, and in order for it to be practical it should be easily adjustable, in order to accomodate a wide range of operator sizes. The machine disclosed in this application covers a wide range of operator sizes with only two adjustments of body-machine contact surfaces. There are five body-machine contact surfaces on each side of this machine (both sides being symmetrical with each other). The first of these body-machine contact surfaces is fixed to an upper rotating effort arm and applies a resistive force to the back side of the operator's upper arm through a circular path about an axis which is common with the sagittal axis of rotation of the operator's rotating shoulder joint. This surface does not need to be adjustable because the distance between the operator's shoulder axis and the back of his upper arm does not vary significantly between operators. The second of these body-machine contact surfaces is attached to a second (lower) rotating effort arm and applies a resistive force to the side of the operator's hip on the contracting side of the body through a circular path about a sagittal axis which passes through approximately the center of the operator's back. This surface does not need to be adjustable relative to the centerline of the operator's body or the seat support surface because the distance between the side of the hip and the centerline of the body and the distance between the side of the hip and the operator's seat while sitting do not vary significantly between operators. The third of these is adjustably attached to the frame of the machine and applies a constraining force to the upper outside of the operator's non-rotating shoulder which serves the function of counteracting the components of force acting at the body-machine force-transmitting contact surfaces which engage the back of the operator's upper arm and the side of the operator's hip. This surface does have to be infinitely adjustable along a horizontal line which runs laterally across the operator's body because the distance between the operator's rotating shoulder joint and the outside of his opposite shoulder will vary both significantly and specifically between operators. The fourth of these is adjustably attached to the same (lower) rotating effort arm that the contact surface which engages the side of the operator's hip is attached to and applies a constraining force to the operator's seat while in the seated position which serves the function of supporting the operator's bodyweight while performing the exercise. This surface must also be infinitely adjustable approximately along a line running radially away from the lower effort arm's axis of rotation because the distance from the operator's rotating shoulder joint down along his spine to his seat while in the seated position will vary both significantly and specifically between operators. The fifth and final body-machine contact surface on each side of the machine is also fixed to the lower rotating effort arm and is positioned to engage the operator's upper back where it acts as a back support while performing the exercise. Infinite variability, which is required for the non-rotating shoulder engaging contact surface and the seat support surface which, in combination, allign the sagittal axis of rotation of the operator's rotating shoulder joint with the machine's upper effort arm's axis of rotation, is easily accomplished through the use of an engaging pair of internal and external threads which actuate a pair of telescoping tubes to which these body-machine contact surfaces are attached (same principle which a vise works on).

A second aspect of the practicality of a body building machine, beside its ability to accomodate a wide range of operator sizes, is the ease with which an operator can get in and out of it. The machine disclosed in this application is easy to get in and out of due to the fact that all of the body-machine forcetransmitting contact surfaces on the machine have open access parallel to the planes with which they make contact with the operator's body while performing the exercise as can be seen in the pictorial view of the machine in FIG. 1.

SUMMARY OF THE INVENTION

As shown in FIGS. 1 & 2, the machine disclosed in this application is of a symmetrical design with symmetrical right-hand and left-hand sides. It is primarily composed of a tubular steel frame to which steel flanges are attached to journal the bearings for the moving parts. The frame of the machine journals an upper and a lower rotating effort arm, both of which rotate about parallel axes which are perpendicular to the machine's plane of symmetry. The upper rotating effort arm's axis of rotation is placed so as to be approximately common with the sagittal axis of rotation of an operator's rotating shoulder joint while the operator is in the operating position (a seated position with the feet clearing the floor and facing perpendicularly away from the machine's plane of symmetry). The lower rotating effort arm's axis of rotation is placed so as to be approximately common with a sagittal axis passing through the center of the average operator's back while in the operating position. The upper effort arm is basically a "T" shaped assembly, which is centered on the machine's plane of symmetry, to which an upper arm engaging pad is attached to each side of the "T". The lower rotating effort arm assembly is basically a modified telescoping "T" shaped assembly, which is also centered on the machine's plane of symmetry, to which a seat supporting pad and a side of the hip engaging pad are attached to each side of the telescoping "T" section of the assembly and a back supporting pad is attached to each side of the stationary section of the assembly. These two effort arm assemblies are mechanically linked together so as to rotate in opposite directions. Also journaled in the machine's frame is a rotating weight arm, which rotates about an axis which is both parallel with the rotational axes of the two effort arms and separated from the rotational axis of the upper effort arm by a specific distance. This rotating weight arm, which is also centered on the machine's plane of symmetry, is basically a straight body which joins transversely into a weight supporting bar at its distal end. The rotating upper effort arm assembly and the rotating weight arm assembly are mechanically linked to each other at axes which are offset from their respective axes of rotation by specific distances by a rigid connecting link of specific length. The upper rotating effort arm, the rotating weight arm, the link joining them, and the frame of the machine join to form a 4-bar linkage which, when acting in conjunction with the rotating weight arm, produces a resistive force which varies throughout the exercise movement. Adjustably attached to the frame of the machine, in a position centered on the machine's plane of symmetry, is a telescoping "T" shaped shoulder bracing assembly. This assembly telescopes along a horizontal line on the machine's plane of symmetry which passes approximately through the upper effort arm's axis of rotation. Attached to each side of this "T" shaped shoulder bracing assembly is an outer shoulder engaging pad. This frame mounted shoulder bracing assembly and the telescoping seat support on the lower effort arm are used in conjunction with each other to allign the sagittal axis of rotation of the operator's rotating shoulder joint with the axis of rotation of the machine's upper rotating effort arm while in the operating position.

DESCRIPTION OF THE PREFERRED EMBODIMENT

Figure 1:
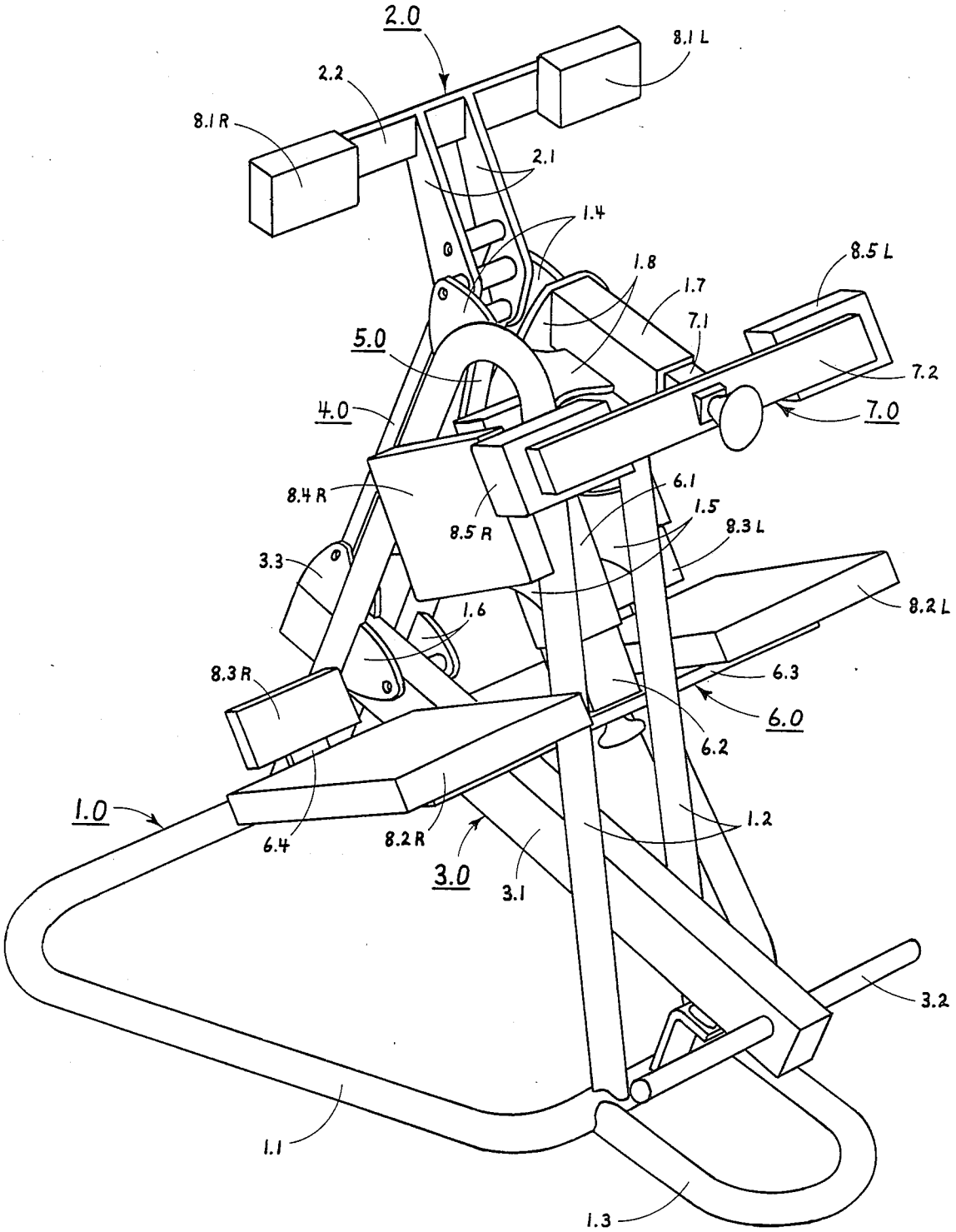
FIG. 1 is a pictorial view of the preferred configuration embodiment of the disclosed lat developing machine with all parts labeled.
Figure 2:
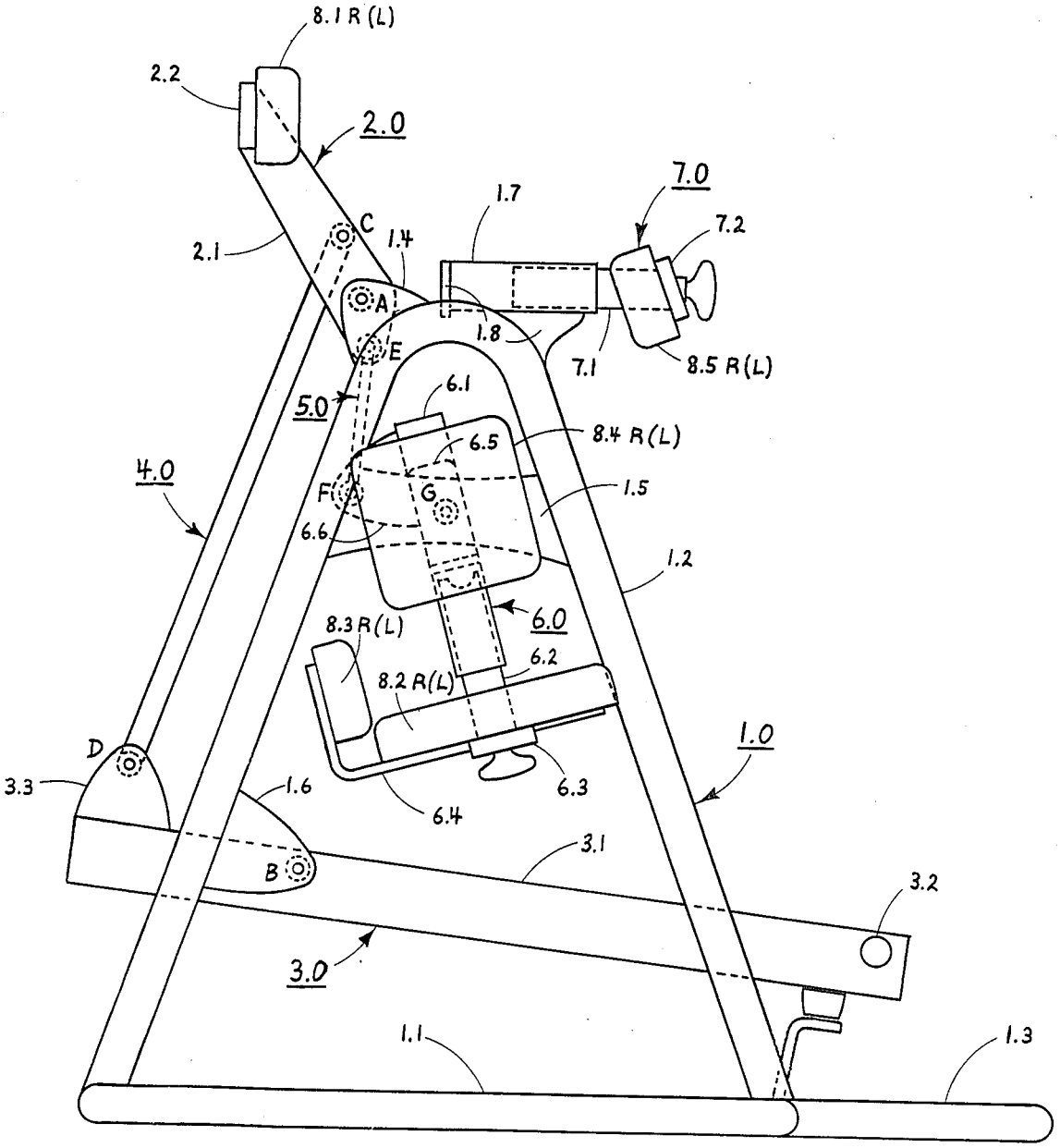
FIG. 2 is a side (plan) view of the preferred configuration embodiment of the disclosed lat developing machine with all parts labeled.

Refer now in detail to FIGS. 1 and 2, which show correspondingly pictorial and side views of the disclosed invention. The primary frame of the invention (assembly 1.0) consist of four round steel tubing loops. The first round steel tubing loop (part 1.1) forms a closed trapezoidally shaped loop which is both symmetrical about the machine's plane of symmetry and lies on the ground plane which is perpendicular to the machine's plane of symmetry. The next two round steel tubing loops (parts 1.2), which are both identical in their inverted "V" shape, lie in parallel planes which are both parallel with and symmetrical about the machine's plane of symmetry and separated by about 8". Each of these two parallel "V" shaped round steel tubing loops (parts 1.2) joins into part 1.1 at its open ends where the planes which these two loops (parts 1.1 and 1.2) lie in intersect. The fourth and last round steel tubing loop (part 1.3) which, like part 1.1, also lies on the ground plane in a position symmetrical about the machine's plane of symmetry, forms a "U" shaped half loop which joins into part 1.1 at its open ends on the ground plane as shown. These four steel tubes join together to form a simple, stable frame for the disclosed invention when welded together as shown and described.

Figure 4:
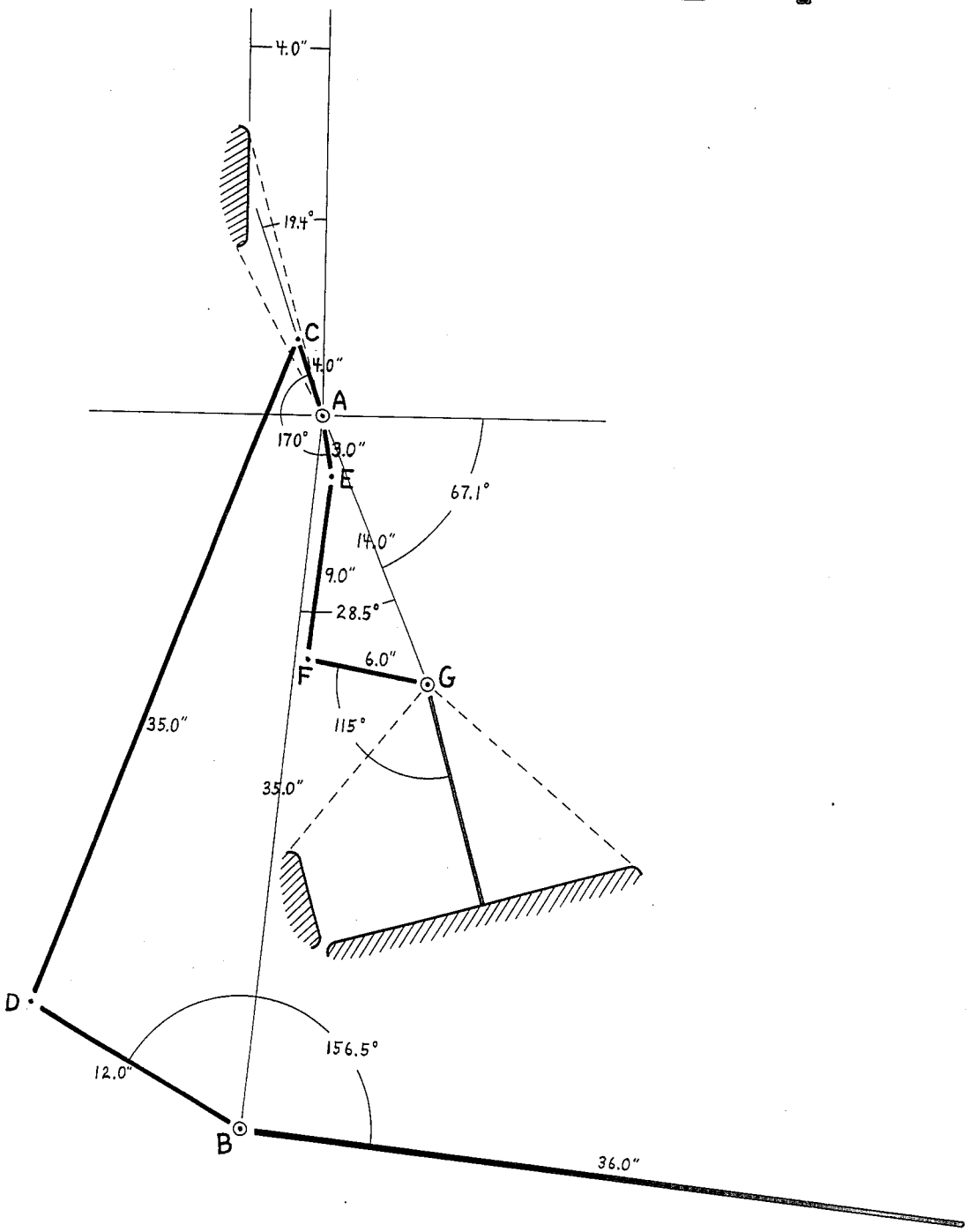
FIG. 4 is a kinematic view of the moving parts of the preferred configuration embodiment of the disclosed lat developing machine showing all critical dimensions and angles.

Centered on and symmetrical about the machine's plane of symmetry is an "upper" rotating effort arm assembly (assembly 2.0) which rotates about an axis (axis A) which is both perpendicular to the machine's plane of symmetry and located far enough off of the ground to allow foot to ground clearance while the operator is performing the exercise from the operating position (a seated position facing perpendicularly away from the machine's plane of symmetry with the sagittal axis of rotation of the operator's rotating shoulder joint common with the axis of rotation of the machine's "upper" rotating effort arm). This "upper" rotating effort arm assembly (assembly 2.0) is journaled in bearings which are centered on axis A in frame attached flanges (parts 1.4) which are located on the forward sides of the upper bend portions of parts 1.2 in a position corresponding approximately with the sagittal axis of rotation of the operator's rotating shoulder joint while in the operating position described above. As shown in FIGS. 1 and 2, this assembly is composed primarily of two identical flat steel bars (parts 2.1) which lie in parallel planes which are perpendicular to the assembly's axis of rotation and separated by about 5". These two parallel flat steel bars (parts 2.1), which extend out radially away from the assembly's axis of rotation, join transversely into a rectangular steel tube (part 2.2) at their distal ends. Part 2.2, which lies on a line which is parallel with the assembly's axis of rotation, is centered about the assembly's plane of symmetry and extends out approximately 15" to each side of the assembly's plane of symmetry. Attached to the distal ends of part 2.2, one on each side of the assembly, are two body-machine contact pads (parts 8.1R and 8.1L) which are positioned to engage the back side of the operator's corresponding right or left rotating upper arm while in the operating position on the corresponding right or left side of the machine. These two contact pads are mounted flush with the aft sides of part 2.2, in such positions that, at the beginning of the exercise movement, the planes of body-machine contact on these pads will lie in a vertical plane which is 4.0" in front of and parallel with a vertical plane passing through axis A. This assembly (assembly 2.0) is mounted to its bearings by a steel pin which is centered on the assembly's axis of rotation (axis A) in bearings which are journaled in parts 2.1 as shown. Parallel to and offset from the assembly's axis of rotation by a distance of 3.0" is a second axis (axis E) which journals a second steel pin which is used in connecting a connecting link from the "upper" rotating effort arm assembly (assembly 2.0) to the "lower" rotating effort arm assembly (assembly 6.0) as shown in FIG. 2. This second axis (axis E) is centered in bearings which are journaled in parts 2.1 as shown. This "upper" rotating effort arm assembly (assembly 2.0) contains a third axis (axis C) which is both parallel with and offset from the assembly's axis of rotation by a distance of 4.0". This third axis (axis C) journals a third steel pin which is used in connecting a connecting link from the "upper" rotating effort arm assembly (assembly 2.0) to the rotating weight arm assembly (assembly 3.0) as shown in FIGS. 1 and 2. This third axis (axis C) is centered in bearings which are journaled in parts 2.1 as shown. At the beginning of the exercise movement, the angle formed between the vertical line passing through axis A and the line connecting axis C with the assembly's axis of rotation (axis A) is approximately 19.4° as shown in FIG. 4 and the angle formed between the line connecting axis E with the assembly's axis of rotation (axis A) and the line connecting axis C with the assembly's axis of rotation (axis A) is 170° as shown in FIG. 4.

Figure 3:
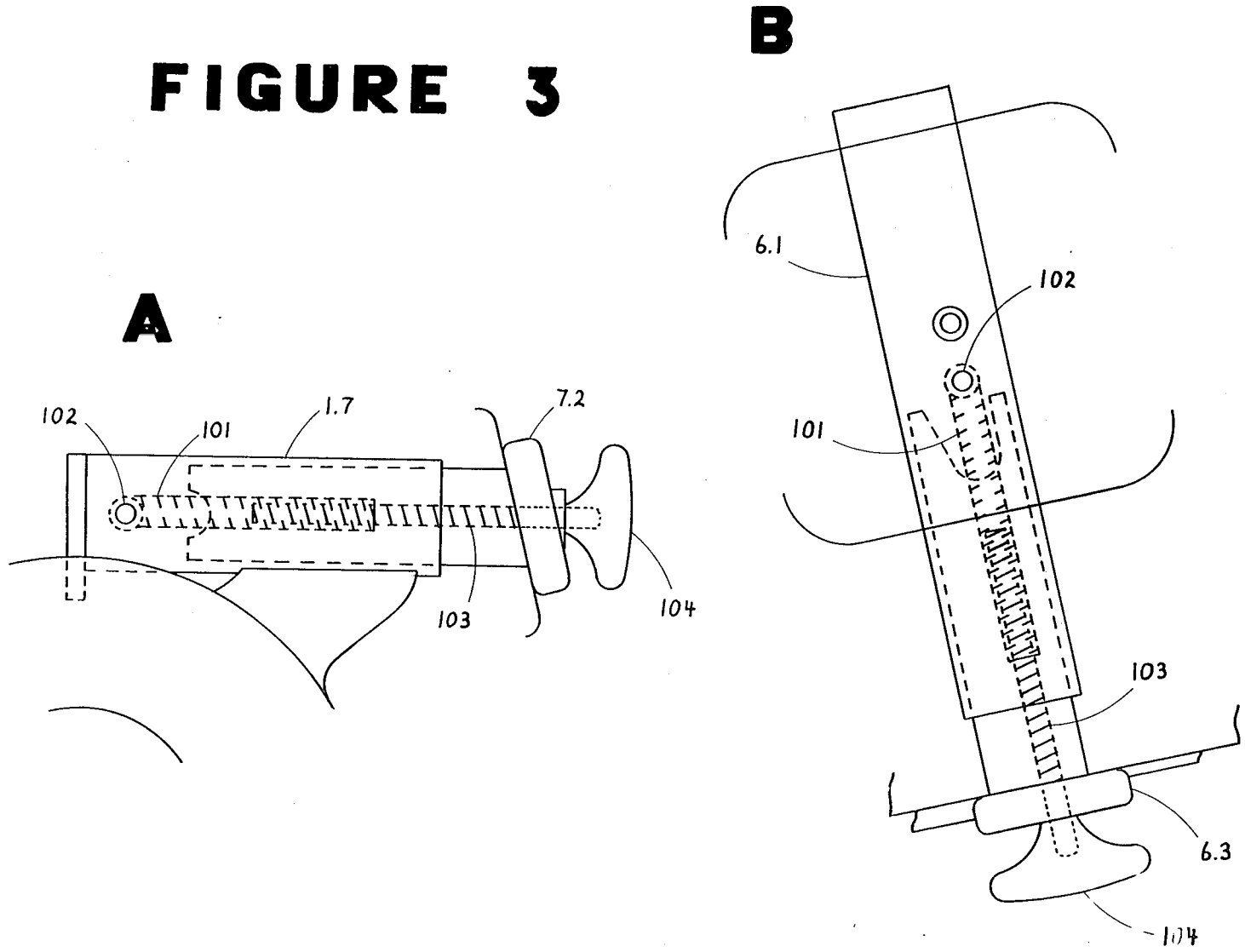
FIGS. 3A & B are detailed plan views of the adjusting mechanism for the corresponding shoulder position adjusting arm (A) and seat height adjusting arm (B) with all parts labeled.

As shown in FIGS. 1 and 2, this invention contains a second "lower" rotating effort arm assembly (assembly 6.0) which rotates about an axis (axis G) which is parallel with the axis of rotation of the "upper" rotating effort arm assembly (assembly 2.0, axis A), separated from it by a specific distance, and positioned to correspond with an axis passing approximately through the center of the average operator's back. This "lower" rotating effort arm assembly (assembly 6.0) is journaled in bearings which are centered on axis G in frame attached flanges (parts 1.5) which are located toward the upper ends between the two "legs" of each of parts 1.2 as shown. The distance between the rotational axes of these two rotating effort arms (assemblies 2.0 and 6.0) is 14.0" and the direction to axis G from axis A is rearward and downward along a line which runs 67.1° below the horizontal line through axis A as shown in FIG. 4. The "lower" rotating effort arm assembly (assembly 6.0) is centered on and symmetrical about the machine's plane of symmetry which is perpendicular to the assembly's axis of rotation. It is composed primarily of a pair of telescoping rectangular steel tubes which lie on the assembly's plane of symmetry which is perpendicular to its axis of rotation. The outer of these two telescoping rectangular steel tubes (part 6.1) is fixed to the assembly's axis of rotation toward its proximal end. Telescoping into the distal end of this outer (fixed) rectangular steel tube (part 6.1) is the inner telescoping rectangular steel tube (part 6.2) which joins transversely into a transverse rectangular steel tube (part 6.3) at its distal end. This transverse rectangular steel tube (part 6.3) lies on a line which is parallel with the assembly's axis or rotation. Part 6.3, which is centered about the assembly's plane of symmetry, extends out approximately 24" to each side of the assembly's plane of symmetry. Attached to the distal ends of part 6.3, one on each side of the assembly, are two body-support pads (parts 8.2R and 8.2L) which are positioned to engage the operator's seat while sitting in the operating position on the corresponding right or left side of the machine. Attached to the forward sides of part 6.3, just below the seat support pads (one on each side), are two "L" shaped steel brackets (parts 6.4) which mount two corresponding body-machine contact pads (parts 8.3R and 8.3L) which are positioned to engage the side of the operator's right or left hip (depending on the side of the machine being used) while in the operating position as shown in FIGS. 1 and 2. The entire telescoping assembly, consisting of the telescoping "T" shaped assembly (parts 6.2 and 6.3 and 6.4) and the body-machine contact pads attached to this assembly, is infinitely adjustable along a line which is radial to the assembly's axis of rotation and runs down the axis of the engaging telescoping tubes. Activation of the telescoping tubes is accomplished through the use of an engaging pair of internal and external threads as shown in detail in FIG. 3B. As shown in FIG. 3B, the upper end of the internal thread (part 101) is both axially and radially anchored by the transverse pin (part 102) to the fixed (outer) telescoping tube (part 6.1). The lower end of the internal thread (part 101) engages the upper end of the external thread (part 103). The lower end of the external thread (part 103) is axially but not radially anchored to the telescoping seat support assembly at the transverse rectangular steel tube (part 6.3). Attached to the bottom end of the external thread 9part 103) is a hand actuated knob (part 104) which is used in operating the adjusting mechanism just described. Attached to the fixed outer telescoping rectangular steel tube (part 6.1), one on each side of the assembly, are two "L" shaped steel brackets (parts 6.5) which mount two corresponding back support pads (parts 8.4R and 8.4L) which are positioned to engage the operator's back while in the operating position on the corresponding right or left side of the machine. This entire "lower" rotating effort arm assembly (assembly 6.0) is mounted to its bearings by a steel pin which is centered on the assembly's axis of rotation (axis G) in bearings which are journaled in the fixed outer telescoping rectangular steel tube (part 6.1) as shown. Parallel to and offset from the assembly's axis of rotation by a distance of 6.0" is a second axis (axis F), which journals a second steel pin which is used in connecting the connecting link mentioned earlier from the "upper" rotating effort arm assembly (assembly 2.0) to the "lower" rotating effort arm assembly (assembly 6.0). This second axis (axis F), which is offset from the assembly's axis of rotation, is centered in bearings which are journaled in a pair of parallel steel flanges (parts 6.6) which are welded to the forward side of part 6.1 as shown. The angle formed between the line connecting axis F with the assembly's axis of rotation (axis G) and the line running radially down the axis of the telescoping rectangular steel tubes is 115° as shown in FIG. 4.

As shown in FIGS. 1 and 2, the "upper" rotating effort arm assembly (assembly 2.0) and the "lower" rotating effort arm assembly (assembly 6.0) are mechanically linked to each other by a rigid steel bar (part 5.0) which contains parallel bushings at its opposite ends. One end of this connecting link (part 5.0) connects by way of a steel pin, as mentioned earlier, to the "upper" rotating effort arm assembly (assembly 2.0) at axis E as shown in FIGS. 1 and 2. The opposite end of this connecting link (part 5.0) connects by way of another steel pin, as mentioned earlier, to the "lower" rotating effort arm assembly (assembly 6.0) at axis F as shown in FIGS. 1 and 2. The distance between the axes of the parallel bushings on this connecting link (part 5.0) is 9.0" as shown in FIG. 4.

As shown in FIGS. 1 and 2, this invention contains a rotating weight arm assembly (assembly 3.0) which rotates about an axis (axis B) which is parallel with the axis of rotation of the "upper" rotating effort arm assembly (assembly 2.0, axis A), separated from it by a specific distance, and placed so that the assembly and any weights mounted at its distal end will clear any obstructions throughout their range of motion. This rotating weight arm assembly (assembly 3.0) is journaled in bearings which are centered on axis B in frame attached flanges (parts 1.6) which are located on the back sides toward the bottom of the forward parallel sections of parts 1.2. The distance between the rotational axes of these two rotating assemblies (assemblies 2.0 and 3.0) is 35.0" and the direction to axis B from axis A is downward along a line which forms a 28.5° angle with the line connecting axis A with axis G as shown in FIG. 4. The rotating weight arm assembly (assembly 3.0) is, like the "upper" and "lower" rotating effort arm assemblies, symmetrical about the machine's plane of symmetry which is perpendicular to its axis of rotation. It is composed primarily of a rectangular steel tube (part 3.1) which is centered on the assembly's plane of symmetry. Attached to the distal end of this rectangular steel tube (part 3.1) and lying in a line which is both parallel with and separated from the assembly's axis of rotation (axis B) by a distance of 36.0" is a weight support bar (part 3.2) which extends outward approximately 12" to each side of the rectangular steel tube (part 3.1). This assembly (assembly 3.0) is mounted to its bearings by a steel pin which is centered on the assembly's axis of rotation (axis B) in bearings which are journaled in part 3.1 as shown. Parallel to and offset from the assembly's axis of rotation by a distance of 12.0" is a second axis (axis D), which journals a second steel pin which is used in connecting the connecting link mentioned earlier from the "upper" rotating effort arm assembly (assembly 2.0) to the rotating weight arm assembly (assembly 3.0). This second axis (axis D), which is offset from the assembly's axis of rotation, is centered in bearings which are journaled in a pair of parallel steel flanges (parts 3.3) which are welded to the upper forward side of part 3.1 as shown. The angle formed between the line connecting the axis of the weight support bar with the assembly's axis of rotation (axis B) and the line connecting axis D with the assembly's axis of rotation (axis B) is 156.5° as shown in FIG. 4.

As shown in FIGS. 1 and 2, the "upper" rotating effort arm assembly (assembly 2.0) and the rotating weight arm assembly (assembly 3.0) are mechanically linked to each other by a rigid steel bar (part 4.0) which contains parallel bushings at its opposite ends. One end of this connecting link (part 4.0) connects by way of a steel pin, as mentioned earlier, to the "upper" rotating effort arm assembly (assembly 2.0) at axis C as shown in FIGS. 1 and 2. The opposite end of this connecting link (part 4.0) connects by way of another steel pin, as mentioned earlier, to the rotating weight arm assembly (assembly 3.0) at axis D as shown in FIG. 4. The distance between the axes of the parallel bushings on this connecting link (part 4.0) is 35.0" as shown in FIG. 4.

Figure 5:
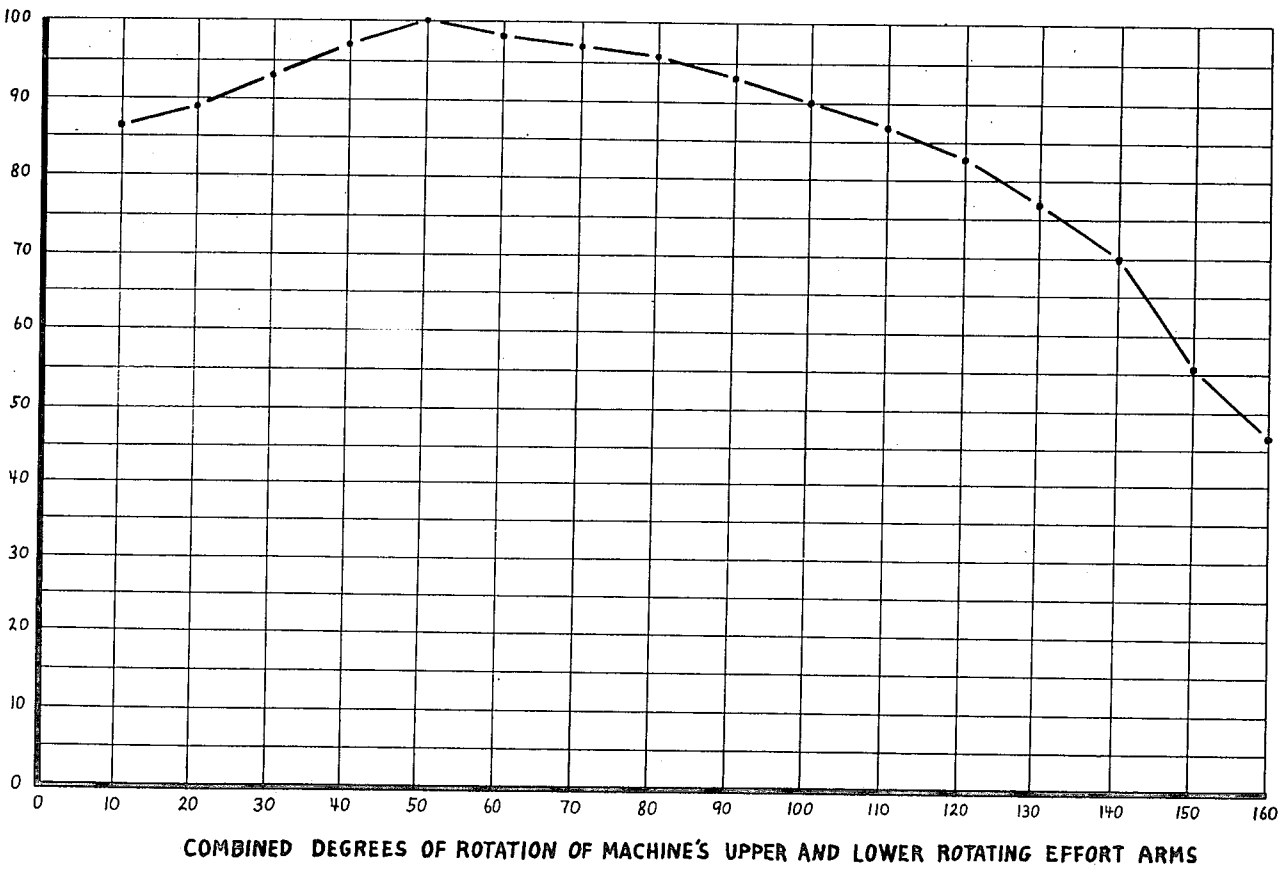
FIG. 5 is a graph generated from kinematic analysis of the force varying mechanism shown and described in FIG. 4. The graph shows the summation of the percentage of weight loaded on the machine's weight bar which is applied at the machine's two body-machine force-transmitting contact surfaces as a function of the combined degrees of rotation of the machine's upper and lower rotating effort arms.

When the "upper" and "lower" rotating effort arm assemblies are in their starting positions (which corresponds to the point where the plane of body-machine contact at the pads on the "upper" rotating effort arm is vertical, as described earlier) and all of the angles and distances for the machine's moving parts (which constitute its force varying mechanism) are as shown in FIG. 4, the corresponding output shown in the graph in FIG. 5 will be obtained while performing the exercise.

Adjustably attached to the machine's frame is a shoulder bracing assembly (assembly 7.0). This assembly moves horizontally down the axis of a pair of telescoping rectangular steel tubes which lie on the machine's plane of symmetry on a line passing approximately through the axis of rotation of the machine's "upper" rotating effort arm assembly. The outer of these two telescoping rectangular steel tubes (part 1.7) is fixed to the machine's frame at its forward end by three steel braces (parts 1.8) which are welded to the machine's frame at the upper ends of parts 1.2 as shown. Telescoping into the rearward end of this outer fixed rectangular steel tube (part 1.7) is the inner telescoping rectangular steel tube (part 7.1) which joins transversely into a transverse rectangular steel tube (part 7.2) at its distal end. Part 7.2, which is centered about the machine's plane of symmetry, extends out approximately 15" to each side of the machine's plane of symmetry along a line which is parallel with the axis of rotation of the machine's "upper" and "lower" rotating effort arms. Attached to the distal ends of part 7.2, one on each side as shown, are two shoulder constraining pads (parts 8.5R and 8.5L) which are positioned to engage the upper outside of the operator's corresponding right or left non-rotating shoulder while in the operating position on the corresponding right or left side of the machine. The entire telescoping shoulder bracing assembly (assembly 7.0) is infinitely adjustable along a horizontal line running down the axis of the engaging telescoping tubes (parts 1.7 and 7.1). Activation of the telescoping tubes is accomplished through the use of an engaging pair of internal and external threads as shown in detail in FIG. 3A. As shown in FIG. 3A, the forward end of the internal thread (part 101) is both axially and radially anchored by the transverse pin (part 102) to the fixed (outer) telescoping tube (part 1.7). The rearward end of the internal thread (part 101) engages the forward end of the external thread (part 103). The rearward end of the external thread (part 103) is axially but not radially anchored to the telescoping shoulder bracing assembly at the transverse rectangular steel tube (part 7.2). Attached to the back end of the external thread (part 103) is a hand actuated knob (part 104) which is used in operating the adjusting mechanism just described.

HOW THE INVENTION WORKS

As shown in FIGS. 1 and 2, the machine disclosed in this application is of a symmetrical design which develops one side of the body at a time, the right side of the body on one side and the left side of the body on the other side. By developing one side of the body at a time a greater range of isolated arm adduction is obtained, which is due to the fact that the shoulder joint can not only be rotated but the spine and hips can also be concurrently rotated in the opposite direction which, in turn, results in a greater range of contraction for the arm adducting lat muscles which cross both shoulder and spinal joints between their points of proximal and distal insertion. The arm adducting lat muscles are developed as they oppose two concurrent coplanar resistive forces which are applied to one side of the operator's body, one at the back of the upper arm through a circular path about an axis which is common with the sagittal axis of rotation of the operator's rotating shoulder joint and the other at the side of the hip through a circular path about a parallel axis which is approximately common with a sagittal axis passing through the center of the average operator's back while in the operating position. These two resistive forces are applied through coplanar circular paths about the corresponding rotating shoulder joint axis and the center of the back axis by corresponding "upper" and "lower" rotating effort arms which rotate about two parallel frame-journaled axes which are approximately common with these two corresponding axes. The position of the operator's rotating shoulder joint is fixed while performing the exercise by two constraining forces which are applied to the operator's body in the same plane as the two resistive forces, one being applied to the upper outside of the operator's non-rotating shoulder and the other to the operator's seat while in the seated (operating) position. The constraining force applied at the upper outside of the operator's non-rotating shoulder, which counteracts the components of force applied at the two body-machine force-transmitting contact surfaces, is applied by a frame-mounted body-machine contact surface which is infinitely adjustable along a horizontal line which is perpendicular to the axis of rotation of the machine's "upper" effort arm. The constraining force applied at the operator's seat, which supports the operator's bodyweight during the exercise, is applied by a "lower" effort arm mounted seat support surface which is infinitely adjustable along a line extending radially away from the axis of rotation of the machine's "lower" effort arm. The frame mounted adjustable shoulder brace and the "lower" effort arm mounted adjustable seat support can both be adjusted so that the sagittal axis of rotation of the operator's rotating shoulder joint will be common with the axis of rotation of the machine's "upper" effort arm. The machine's two effort arms, the "upper" which contains the back-of-the-arm engaging surface and the "lower" which contains the side-of-the-hip and seat engaging surfaces, are mechanically linked to each other at axes which are both parallel with and offset from their respective axes of rotation by a specific distance by a rigid connecting link, which also has a specific length, in such a way that they rotate in opposite directions and the "lower" effort arm goes through approximately half the rotation of the "upper" effort arm. This body-machine force-transmitting complex (composed of the "upper" and "lower" rotating effort arms and the link connecting them) is mechanically linked to a rotating weight arm which is also journaled in the machine's frame. This rotating weight arm rotates about an axis which is parallel with the axis of rotation of the "upper" rotating effort arm, separated from it by a specific distance, and placed so that the assembly and any weights mounted at its distal end will clear any obstructions throughout their range of motion. The "upper" rotating effort arm and the rotating weight arm are mechanically linked to each other at axes which are both parallel with and offset from their respective axes of rotation by a specific distance by a rigid connecting link which also has a specific length. The "upper" rotating effort arm, the rotating weight arm, the link joining them, and the frame of the machine all join together to form a four-bar linkage whose members' lengths and orientations have been determined through kinematic analysis to apply, when acting in conjunction with the sinusoidally changing value of force applied by the machine's rotating weight arm as the weights swing through a circular path through the gravitational field, the predetermined variably resistive force shown in the graph in FIG. 5, at the arm and hip engaging body-machine force-transmitting contact surfaces. As shown in the graph, the force applied at the machine's arm and hip engaging body-machine force-transmitting contact surfaces, which is designed to correspond to the normal strength-to-position force applying capabilities of the average operator in the arm adduction body movement, varies as a function of the combined degrees of rotation of the machine's "upper" and "lower" rotating effort arms.

CONCLUSION

This invention, by applying a resistive force to the upper arm through a circular path about the sagittal axis of rotation of the rotating shoulder joint, eliminates biceps involvement in the exercise, resulting in a pure arm adduction exercise movement. This, in turn, better isolates the arm adducting lat muscles than the "pulling" movements associated with other "lat developing" machines which, in turn, results in greater lat building potential. In addition, by utilizing upper and lower rotating effort arms and exercising one side of the body at a time, this invention applies a resistive force directly to the arm adducting lat muscles through a greater range of contraction than is available on other lat developing machines of bilateral design which use a pure arm adduction exercise movement and only one rotating effort arm per side. This again results in greater lat building potential. The resistive force applied by this machine varies as a function of the degrees of rotation of the operator's shoulder and spinal joints and is correlated to the normal strength-to-position capabilities of the arm adducting lat muscles which also results in greater lat building potential than lat building machines which apply a constant load. This variably resistive force is obtained through the use of a 4-bar linkage acting in conjunction with a rotating weight arm. This 4-bar linkage/rotating weight arm force-varying mechanism consist of only three moving parts connected to each other and to the frame of the machine at a total of four pivotal joints (the whole machine having only five moving parts and seven pivotal joints) making the machine inherently more reliable, less noisy, and more friction free than a comparable machine using cams, chains, or cables.

Having thus described the invention and its function, what is claimed is as follows:

1. An arm adduction exercise machine for exercising the arm adducting muscles of an operator, comprising:

a rigid frame including a base portion and an upstanding portion having a front, rear, top and bottom, wherein the bottom is rigidly secured to the base portion;

a upper rotating assembly mounted at the rear and approximate the top of said upstanding portion so as to rotate about a first horizontal axis, wherein said first axis is positioned to be coaxial with the sagittal axis of rotation of an operator's shoulder;

said upper rotating assembly comprising a crank with offset arm which includes a contact surface for engaging the back side of an operator's exercising upper arm;

a lower rotating assembly mounted intermediate the front and rear of said upstanding portion so as to rotate about a second horizontal axis which is below and parallel to said first axis, wherein said second axis is positioned to correspond with the center of said operator's back;

said lower rotating assembly comprising a crank which is adjustable in length and includes an offset arm which has a seat mounted at one end, said seat including at least one hip engaging surface so that the operator's hip on the side which corresponds to the exercising upper arm is engaged;

a rigid rotating weight arm assembly journaled to said frame which rotates about a third horizontal axis which is both parallel with and separated by a specific distance from said first axis;

said rotating weight arm assembly includes means for loading weights onto at a point offset from said third axis;

said upper rotating assembly and said rotating weight arm assembly are mechanically linked to each other at fourth and fifth horizontal axes which are both parallel with and offset by specific distances from said first and third axes respectively, by a first rigid connecting link which has a specific length between its centers of connection;

said upper and lower rotating assemblies are mechanically linked to each other at sixth and seventh horizontal axes which are both parallel with and offset by specific distances from said first and second axes respectively, by a second rigid connecting link which has a specific length between its centers of connection in such a way that the upper and lower rotating assemblies rotate in opposite directions, thereby when a rearward and downward force is applied to said upper assembly's arm engaging contact surface, said second link will cause said lower assembly's hip engaging contact surface to move rearward and upward, so as to bring the operator's hip closer to the operator's upper arm;

said upper rotating assembly, said rotating weight arm assembly, said first link and said frame of said exercise machine join together to form a four-bar linkage system which functions in conjunction with the rotating weight arm assembly to provide a variably resistive force at said arm and hip engaging surfaces, which force varies as a function of the positions of the arm and hip engaging contact surfaces.

2. The arm adduction exercise machine of claim 1 further including:

an adjustable shoulder brace assembly which is rigidly fixed to said frame approximate the top and front so as to be adjustable along an axis which passes both perpendicular to and approximately through said axis of rotation of said upper rotating assembly;

said shoulder brace assembly includes a contact surface for engaging the operator's shoulder opposite to that which is being exercised by said exercising upper arm.

* * * * *